US008288697B1

(12) United States Patent
Wolf

(10) Patent No.: US 8,288,697 B1
(45) Date of Patent: Oct. 16, 2012

(54) CHANGING ROCKET ATTITUDE TO IMPROVE COMMUNICATION LINK PERFORMANCE IN THE PRESENCE OF MULTIPLE ROCKET PLUMES

(75) Inventor: David E. Wolf, Berlin, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 352 days.

(21) Appl. No.: 12/648,663

(22) Filed: Dec. 29, 2009

(51) Int. Cl.

| | |
|---|---|
| ***F42B 15/01*** | (2006.01) |
| ***F41G 7/00*** | (2006.01) |
| ***F41G 9/00*** | (2006.01) |
| *F42B 15/00* | (2006.01) |

(52) U.S. Cl. ..... 244/3.11; 244/3.1; 244/3.14; 244/3.15; 244/3.19; 89/1.11; 342/13; 342/61; 342/62

(58) Field of Classification Search ..... 244/3.1–3.3; 89/1.11; 342/13–20, 61, 62, 175, 195, 73–81, 342/165, 173, 174

See application file for complete search history.

(56) References Cited

U.S. PATENT DOCUMENTS

| | | | | |
|---|---|---|---|---|
| 4,010,467 | A * | 3/1977 | Slivka | 342/77 |
| 4,148,029 | A * | 4/1979 | Quesinberry | 342/77 |
| 4,194,204 | A * | 3/1980 | Alpers | 342/80 |
| 4,204,210 | A * | 5/1980 | Hose | 342/62 |
| 4,752,779 | A * | 6/1988 | Jones et al. | 342/80 |
| 4,987,419 | A * | 1/1991 | Salkeld | 342/75 |
| 5,131,602 | A * | 7/1992 | Linick | 244/3.14 |
| 5,583,508 | A * | 12/1996 | Pugh et al. | 342/62 |
| 6,596,976 | B2 * | 7/2003 | Lin et al. | 244/3.19 |

* cited by examiner

*Primary Examiner* — Bernarr Gregory
(74) *Attorney, Agent, or Firm* — Howard IP Law Group, PC

(57) ABSTRACT

A method for commanding an attitude change of a boosting missile to tend to maintain good communication link quality includes the step of precalculating attenuation of a link between the boosting missile and a ground station in the presence and absence of multiple missile plumes. If the actual link attenuation is less than the precalculated attenuation in the absence of multiple missile plumes, no attitude change is commanded. If the actual link attenuation exceeds the precalculated value, the actual link attenuation is compared with the calculated attenuation in the presence of multiple missile plumes. If the calculated multiple plume RF attenuation is less than the actual link attenuation, the attenuation is deemed to be caused by some factor other than multiple plume attenuation, and produces a flag for commanding a change in attitude.

20 Claims, 6 Drawing Sheets

CHANGING ROCKET ATTITUDE TO IMPROVE COMMUNICATION LINK PERFORMANCE IN THE PRESENCE OF MULTIPLE ROCKET PLUMES

This invention was made with Government Support under Contract No. N00024-03-C-6110 awarded by the Department of the Navy. The Government has certain rights in this invention.

BACKGROUND

Communication from "fixed" Earth stations such as ground stations or ship-borne stations to rocket-propelled objects such as missiles is now common. The "Earth" station may even be an aircraft in this context. The communication is often in a military scenario in which the missile is defensive, and is commanded and or guided toward its target by signals transmitted from the Earth station. In one common scenario, a ship or ground station includes a radar or other sensing system which tracks both the target and the missile, and updates the information available to the missile guidance to improve the likelihood of hitting the target.

The quality of the communication link between the Earth station and the missile in a "link budget" which is determined by analysis that captures all of the hardware and environmental gains and losses of the communication path. Among the elements which can be incorporated into the link budget analysis during the boost phase or portion of the missile flight is rocket plasma plume radio-frequency (RF) attenuation, thought to be attributable to free electrons arising from alkali metal impurities found in the rocket propellant.

FIG. 1 illustrates a scenario 10 with a communication link, illustrated as a dash line 12, from a ground station 14 including an antenna 15. The communication link 12 passes through the plasma plume 16 of a missile 18 to get to the missile antenna 20. The plume is illustrated generally as 16, with various lines 16*a*, 16*b*, 16*c*, and 16*d* representing contours of different temperature ranges. The aspect angle Θ is illustrated as the angle between the RF path of the communication link 12 and the longitudinal axis 22 of the missile.

The radio-frequency (RF) link budget loss attributable to the plume is calculated by a complex and expensive modeling procedure. The calculation yields plume attenuation for an engine under various flight conditions, such as altitude, Mach number, and aspect angle.

FIG. 2 is a simplified representation of a prior-art control system scenario 210. In FIG. 2, the ground station 210 communicates with the antenna 20 of missile 18 by way of a bidirectional wireless link. The link may carry missile targeting information, including missile attitude commands and other telemetry. The current link quality or link budget is compared with a predetermined or precalculated plume attenuation in a microprocessor (μP) block 212. The communication link, 12 is monitored during flight of missile 18 to determine the link attenuation. The link attenuation is compared in block 212 with the predetermined plume attenuation information to determine if a significant part of the link attenuation is attributable to the plume. If the plume attenuation is determined to be significant, a missile track control block 214 adjusts the track of the missile, so that the communication link 12 does not pass through the plume 16, or passes through a lower-attenuation portion of the plume. This in turn eliminates or reduces the RF attenuation attributable to the passage of the RF through the plume. Thus, if the aspect angle at which the missile is "viewed" from the RF source is such that the RF signal passes through a portion of the plume that, in conjunction with other factors, occasions excessive attenuation or signal loss, the modification of the track is selected to move the missile track or path relative to the RF signal path so as to reduce the plume attenuation and thereby improve the link budget to provide reliable communications.

Improved methods are desired for determining link attenuation budgets in complex situations.

SUMMARY

A method according to an aspect of the disclosure is for adjusting the track or path of a boosting missile in order to maintain the quality or attenuation of a communication link between the missile and a communication device in the presence of at least one other boosting missile. The method comprises the step of precalculating a communication link budget including an attenuation factor, where the communication link budget attenuation factor includes a table of the attenuation characteristics of a communication path extending to a single missile which, when operating, generates a plasma plume. A first missile is provided, with the first missile including a motor or engine which, when operating, generates a plasma plume, and which also includes an antenna for transducing signals with a communication device. The first missile is initialized and launched. The number of additional boosting missiles traveling along paths lying in or immediately adjacent to the line of sight between the communication device and the first missile is determined. The quality or attenuation factor of the link budget in the presence of the additional boosting missiles is determined. If (a) the link budget quality falls below a predetermined standard and (b) the loss is deemed to be attributable to the plumes of the additional boosting missiles, the track of a missile is adjusted to improve the quality. In a particular mode of this method, the step of determining the quality of the link budget in the presence of said additional boosting missile or missiles includes the step of calculating $$A_{TOTAL} = \left[1 + 0.1\left(\frac{R_{eq}}{R_1}\right)\right]\left[1 + \frac{0.26(h_1 - h_{avg})}{A_1}\right]A_1$$

where:

$A_1$ is the predetermined value of plume attenuation for the missile with which communication takes place;

$h_1$ is the altitude associated with the missile with which communication takes place;

$A_{TOTAL}$ is the total attenuation for multiple plumes 1 through N, which plumes may be at different altitudes, and for $h \leqq 70$ km;

$h_{avg}$ is the average altitude of all plumes (km); and $R_{eq}$ is the equivalent nozzle plane exit radius based on the total nozzle exit plane area associated with all the missile plumes $$R_{eq}=(R_1^2+R_2^2+R_3^2+R_4^2+\ldots+R_N^2)^{1/2}$$

According to another aspect of the disclosure, a method is provided for commanding an attitude change of a boosting missile to tend to maintain good communication link quality. The method includes the step of precalculating attenuation of a link between the boosting missile and a ground station in the presence and in the absence of multiple missile plumes. If the actual link attenuation is less than the precalculated attenuation in the absence of multiple missile plumes, no attitude change is commanded. If the actual link attenuation exceeds the precalculated value, the actual link attenuation is compared with the calculated attenuation in the presence of multiple missile plumes. If the calculated multiple plume RF attenuation is less than the actual link attenuation, the attenuation is deemed to be caused by some factor other than multiple plume attenuation, and produces a flag for commanding a change in attitude of the boosting missile. In a particular mode of this method, the step of determining the quality of said link budget in the presence of said additional boosting missile or missiles includes the step of calculating $$A_{TOTAL} = \left[1 + 0.1\left(\frac{R_{eq}}{R_1}\right)\right]\left[1 + \frac{0.26(h_1 - h_{avg})}{A_1}\right]A_1$$

where:

$A_1$ is the predetermined value of plume attenuation for the missile with which communication takes place;

$h_1$ is the altitude associated with the missile with which communication takes place;

$A_{TOTAL}$ is the total attenuation for multiple plumes 1 through N, which plumes may be at different altitudes, and for $h \leqq 70$ km;

$h_{avg}$ is the average altitude of all plumes (km); and $R_{eq}$ is the equivalent nozzle plane exit radius based on the total nozzle exit plane area associated with all the missile plumes $$R_{eq}=(R_1^2+R_2^2+R_3^2+R_4^2+\ldots+R_N^2)^{1/2}$$

A method according to another aspect of the disclosure is for adjusting the track or path of a boosting missile to maintain the quality of a communication link between the missile and a communication device in the presence of at least one other boosting missile. The method comprises the steps of precalculating a communication link budget including an attenuation factor, where the communication link budget attenuation factor includes a table of the attenuation characteristics of a communication path extending to a single missile which, when operating, generates a plasma plume. A first missile is provided, the first missile including a motor which, when operating, generates a plasma plume, and which also includes an antenna for transducing signals with a communication device. The first missile is initialized and launched. The characteristics of the environment of the first missile are determined, including the number of additional boosting missile or missiles traveling along paths lying adjacent to the line of sight extending between the communication device and the first missile, and also including information relating to the exit plane areas of the boosting missiles. The quality of the link budget is determined in the presence of the additional boosting missile or missiles as a function of the exit plane areas of the missiles.

A method according to yet another aspect of the disclosure is for determining if the attitude of a boosting missile should be modified in order to improve the quality of a communication link extending between the boosting missile and a stationary communication device. The method comprises the step of precalculating a missile link budget including attenuation attributable to the engine plume of the boosting missile with which communication is desired. The missile with which communication is desired is launched. The quality of the link is determined as good or bad. If the quality of the link is bad, the actual link attenuation to the boosting missile is determined under the existing conditions, and the actual link attenuation is compared to the precalculated value to determine if the actual link attenuation is greater than or less than the precalculated value. If the actual link attenuation is less than the precalculated value, a signal is generated indicating that the boosting missile attitude need not be changed. The link attenuation in the presence of multiple missile plumes is calculated. If the actual link attenuation is greater than the precalculated value, the actual link attenuation is compared with the calculated link attenuation in the presence of multiple missile plumes, and if the calculated link attenuation in the presence of multiple missile plumes is less than the actual link attenuation, a signal is generated indicating that the boosting missile attitude need not be changed. If the calculated link attenuation in the presence of multiple missile plumes is greater than the actual link attenuation, a signal is generated indicating that the boosting missile attitude needs to be changed.

DETAILED DESCRIPTION

The possibility exists that a military scenario will involve attack by a plurality of hostile vehicles or missiles, or that multiple defensive missiles will be used to engage the hostile missile(s). In such a scenario, there is the possibility that the communication link associated with one of the missiles with which communication is desired will pass through the plasma plume of another missile. If this happens, even for a short period of time, the quality of the communication link might be severely compromised. Such compromise might occur at an inopportune time, such that the disruption of communication could lead to failure of the defensive missile to properly engage the hostile target.

Figure 1:
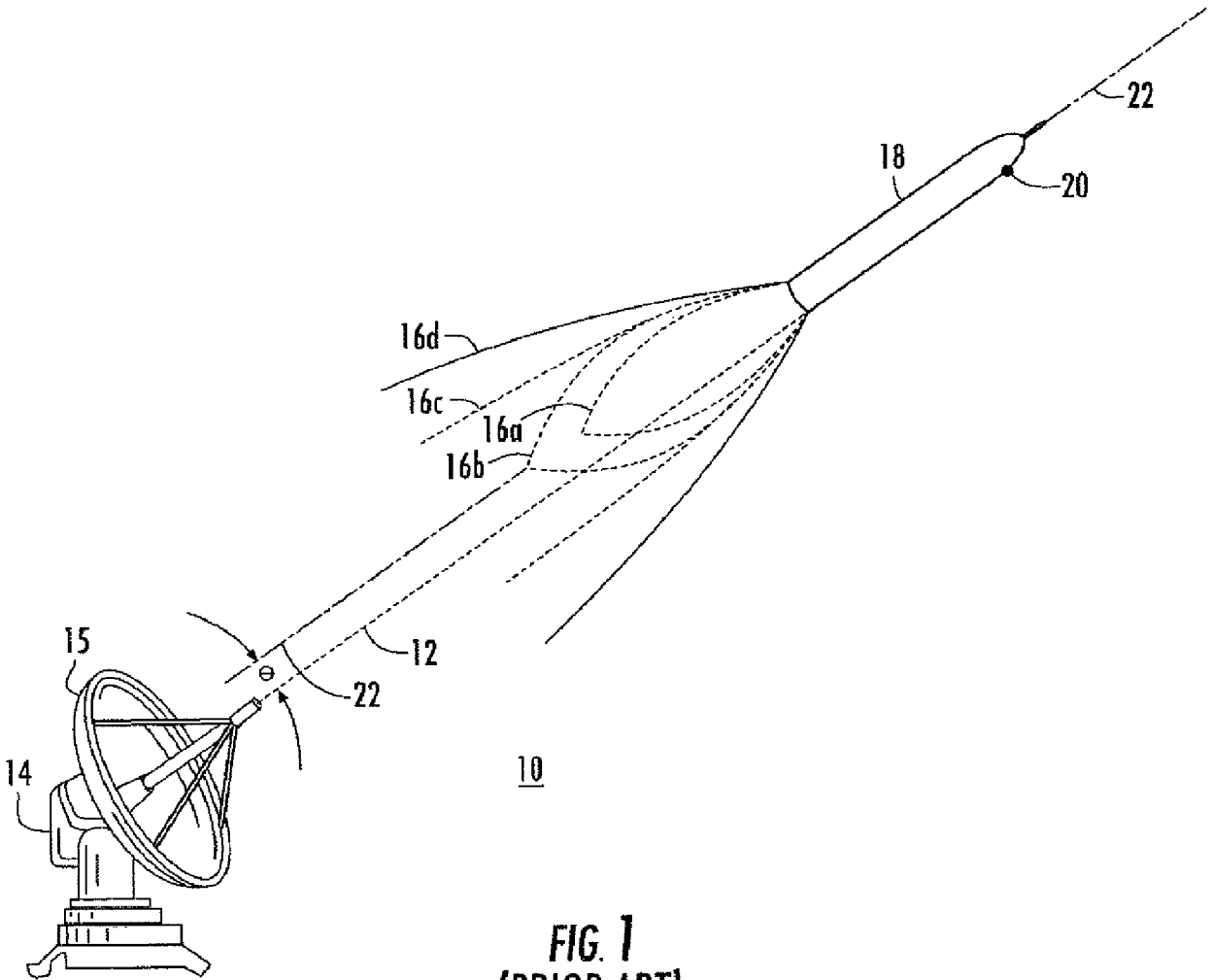
FIG. 1 (PRIOR ART)
FIG. 1 is a simplified representation of a prior-art communication link between a ground station and a missile, in which the link includes at least a portion passing through a portion of a plasma plume, thereby introducing undesired path attenuation attributable to the plume.
Figure 3:
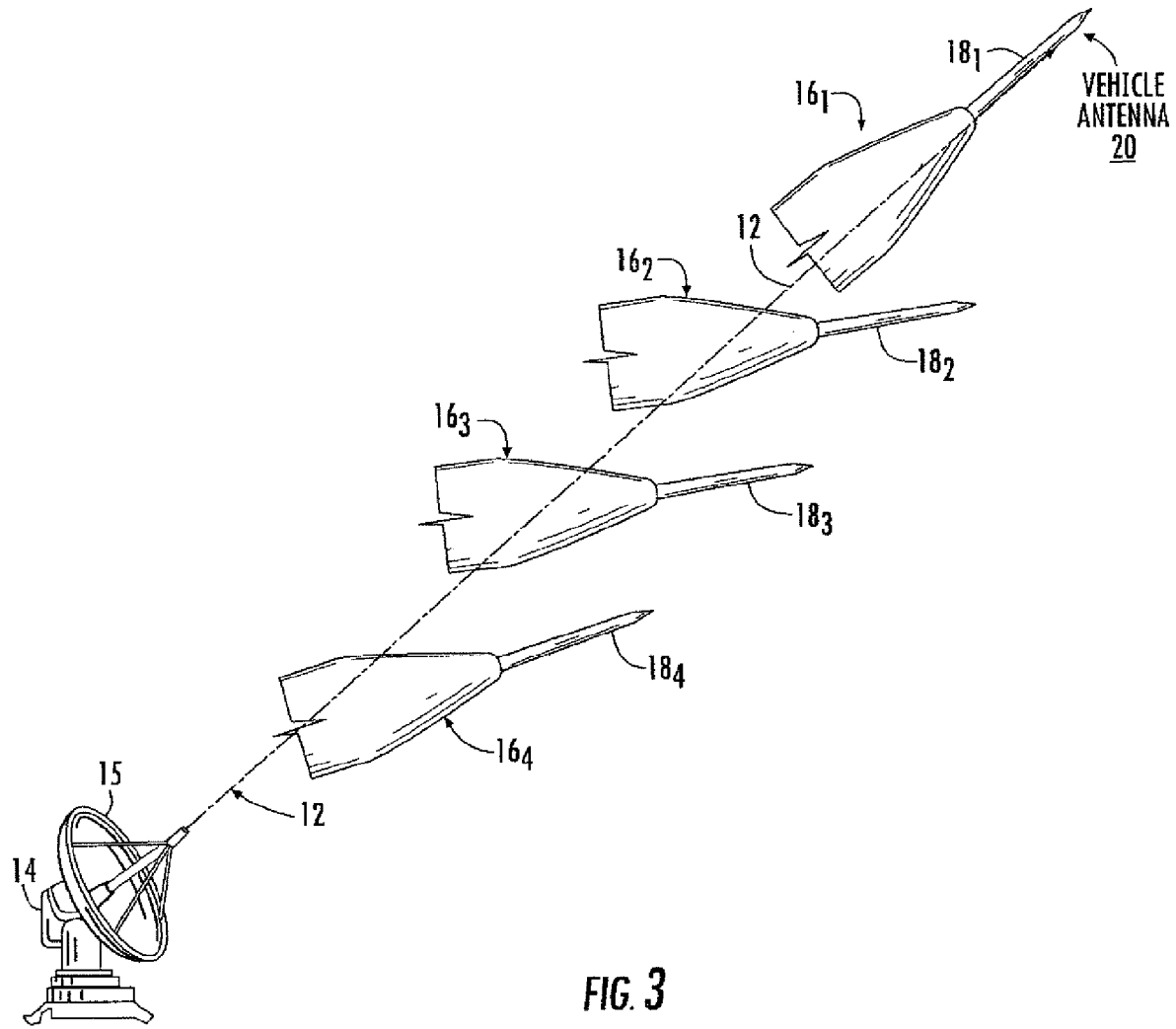
FIG. 3 is a simplified representation of a communication link between a ground station and a missile, in which the link includes portions passing through portions of the plasma plume of multiple missiles.

FIG. 3 illustrates a scenario similar to that of FIG. 1, except that the communication link 12 passes through portions of the plasma plumes of additional missile rocket engines. More particularly, FIG. 3 illustrates four missiles, designated $\mathbf{18}_1$, $\mathbf{18}_2$, $\mathbf{18}_3$, and $\mathbf{18}_4$, having mutually different headings or tracks as evidenced by their attitudes. Missiles $\mathbf{18}_1$, $\mathbf{18}_2$, $\mathbf{18}_3$, and $\mathbf{18}_4$ are associated with plasma plumes designated $\mathbf{16}_1$, $\mathbf{16}_2$, $\mathbf{16}_3$, and $\mathbf{16}_4$, respectively. Communication path or link 12 extends from antenna 15 of ground station 14 to antenna 20 on missile $\mathbf{18}_1$, passing through portions of plumes $\mathbf{16}_2$, $\mathbf{16}_3$, and $\mathbf{16}_4$ in so doing. As might be expected, additional attenuation is introduced into path or link 12 by the additional plasma plumes $\mathbf{16}_2$, $\mathbf{16}_3$, and $\mathbf{16}_4$.

According to an aspect of the disclosure, a pre-calculated single-plume RF signal attenuation, which may be generated in the prior-art manner, is used as an input to a multiple-plume attenuation estimation algorithm. The link budget is compared with the results of the multiple-plume attenuation estimate, and if it appears that the multiple-plume attenuation is significant, the track of at least one of the missiles is modified to reduce the multiple-plume attenuation. While ordinarily the track will be modified of the missile with which communications are desired, it is also possible to modify the track of one or more of the missiles causing the second or multiple plume(s).

In general, the plume RF signal attenuation A is a function $$A=f(R,h,\theta,\epsilon) \tag{1}$$

where:

R is the nozzle exit plane radius associated with plume size;

h is plume altitude (A increases as h in endo-atmosphere);

Θ is aspect angle; and

ϵ is plume electron density (varies with location in the plume).

Figure 2:
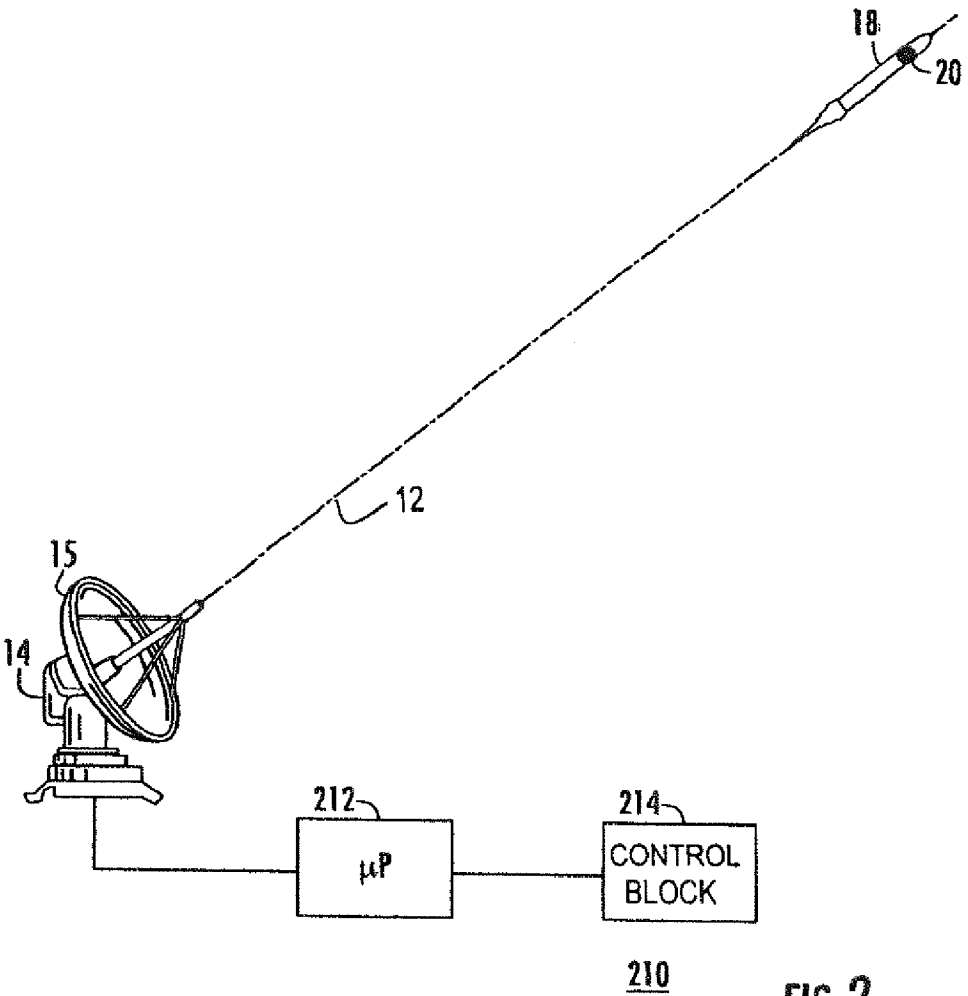
FIG. 2 (PRIOR ART)
FIG. 2 is a simplified representation of a prior-art link attenuation control arrangement which compares predetermined plume attenuation with the ground-to-missile link quality or attenuation, and makes a decision as to whether the link attenuation has a significant contribution from the plume attenuation, and if so, modifies the missile track so as to reduce the attenuation of that portion of the plume through which the link passes.

According to an aspect of the disclosure, plume attenuation is calculated or estimated for a multiple-plume scenario such as that of FIG. 3, and a comparison is made between the plume attenuation so calculated and the actual link budget or attenuation. If the link or path attenuation is deemed to consist in large part or primarily of the single-plume attenuation, the track of at least the signal-receiving missile (18 of FIG. 2) is modified to reduce the plume-attributable attenuation. This modification may be accomplished by changing the attitude of the missile 18. If the link or path attenuation is deemed to be attributable, at least in part, to multiple-plume attenuation, the attenuation is deemed to be transitory and the attitude of missile 18 is not changed.

Figure 4A:
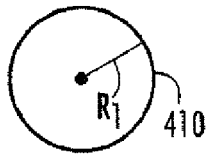
FIGS. 4A, 4B, 4C, 4D, and 4E represent cross-sections of the plumes of various missiles.
Figure 4B:
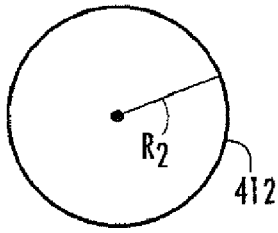
Figure 4C:
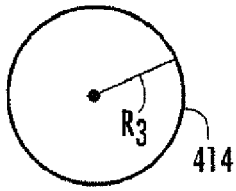
Figure 4D:
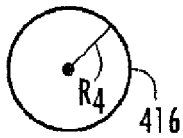
Figure 4E:
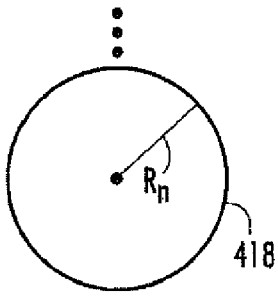

As suggested by the placement of the various missiles $\mathbf{18}_1$, $\mathbf{18}_2$, $\mathbf{18}_3$, and $\mathbf{18}_4$ in FIG. 3, the various missiles affecting the RF path or link may be at different altitudes. The various plumes will be of different sizes because of differences in the nozzle exit plane radii, and also because of the differences in altitude and therefore ambient pressure. The altitude will not affect the diameter of the plume directly at the exit plane, but will affect the plume diameter at planes removed from the exit plane. FIG. 4A is a notional cross-sectional illustration 410 of the plume of missile $\mathbf{18}_1$ with nozzle radius $R_1$, at a distance from the exit nozzle and at a first altitude. Plume 410 will introduce attenuation when the RF signal path passes therethrough, and this attenuation will depend upon the aspect angle at which the path passes through the plume. FIGS. 4B, 4C, 4D, and 4F illustrate cross-sections 412, 414, 416, and 418, respectively, of various plumes of rocket engines with exit plane diameters $R_2$, $R_3$, $R_4$, . . . , $R_N$, respectively.

Plume attenuation increases with altitude up to a maximum of about 70 kilometers (km) at constant aspect angle. In a scenario including multiple plumes, it would be difficult to determine the individual values of the aspect angle, the electron densities of each plume (other than the missile with which communications are desired) at the aspect angle in question. Even if determined, the values affecting the attenuation change from moment to moment, rendering direct calculation difficult.

One might expect that the total RF attenuation attributable to multiple plumes would be, if calculated, the sum of all the individual plume RF attenuations along the line-of-sight or communication path. Performing a calculation for multiple plumes from missiles having the same size nozzles and at the same altitude yields a value for the total plume attenuation that is less than the sum of the calculated plume attenuation values.

It has been discovered that the total plume RF attenuation in the case of multiple plumes is a function of the total nozzle exit plane area, which is to say that it is proportional to $R^2$. The attenuation $A_{TOTAL}$ attributable to the passage of RF through multiple plumes is calculated, according to an aspect of the disclosure, as $$A_{TOTAL} = \left[1 + 0.1\left(\frac{R_{eq}}{R_1}\right)\right]\left[1 + \frac{0.26(h_1 - h_{avg})}{A_1}\right]A_1 \tag{2}$$

where:

$A_1$ is the predetermined value of plume attenuation for the missile with which communication takes place ($18_1$ of FIG. 3);

$h_1$ is the altitude associated with the missile with which communication takes place;

$A_{TOTAL}$ is the total attenuation for multiple plumes 1 through N, which plumes may be at different altitudes, and for $h \leqq 70$ km;

$h_{avg}$ is the average altitude of all plumes (km); and $R_{eq}$ is the equivalent nozzle plane exit radius based on the total nozzle exit plane area associated with all the missile plumes $$R_{eq}=(R_1^2+R_2^2+R_3^2+R_4^2+\ldots+R_N^2)^{1/2} \tag{3}$$

Note that $h_{avg}$ will always be less than or equal to $h_1$.

Figure 5:
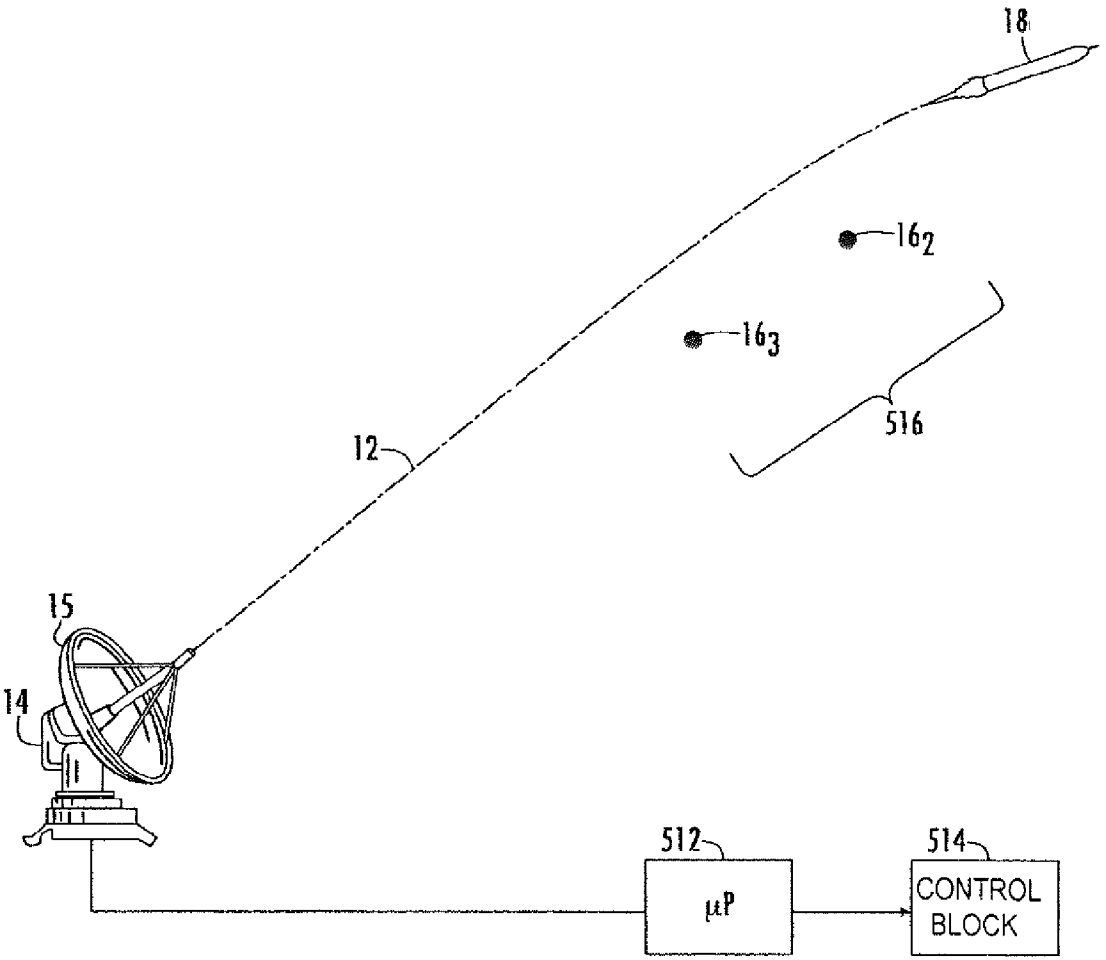
FIG. 5 is a simplified block diagram of a control system according to the disclosure.

FIG. 5 is a simplified block diagram illustrating a portion of a system for communication between a radar system represented by elements 14 and 15 and a missile 18 by way of a communication link 12 in a scenario including the presence of multiple plumes of a set 516 of additional plumes, some of which are designated as $\mathbf{16}_2$ and $\mathbf{16}_3$.

Figure 6:
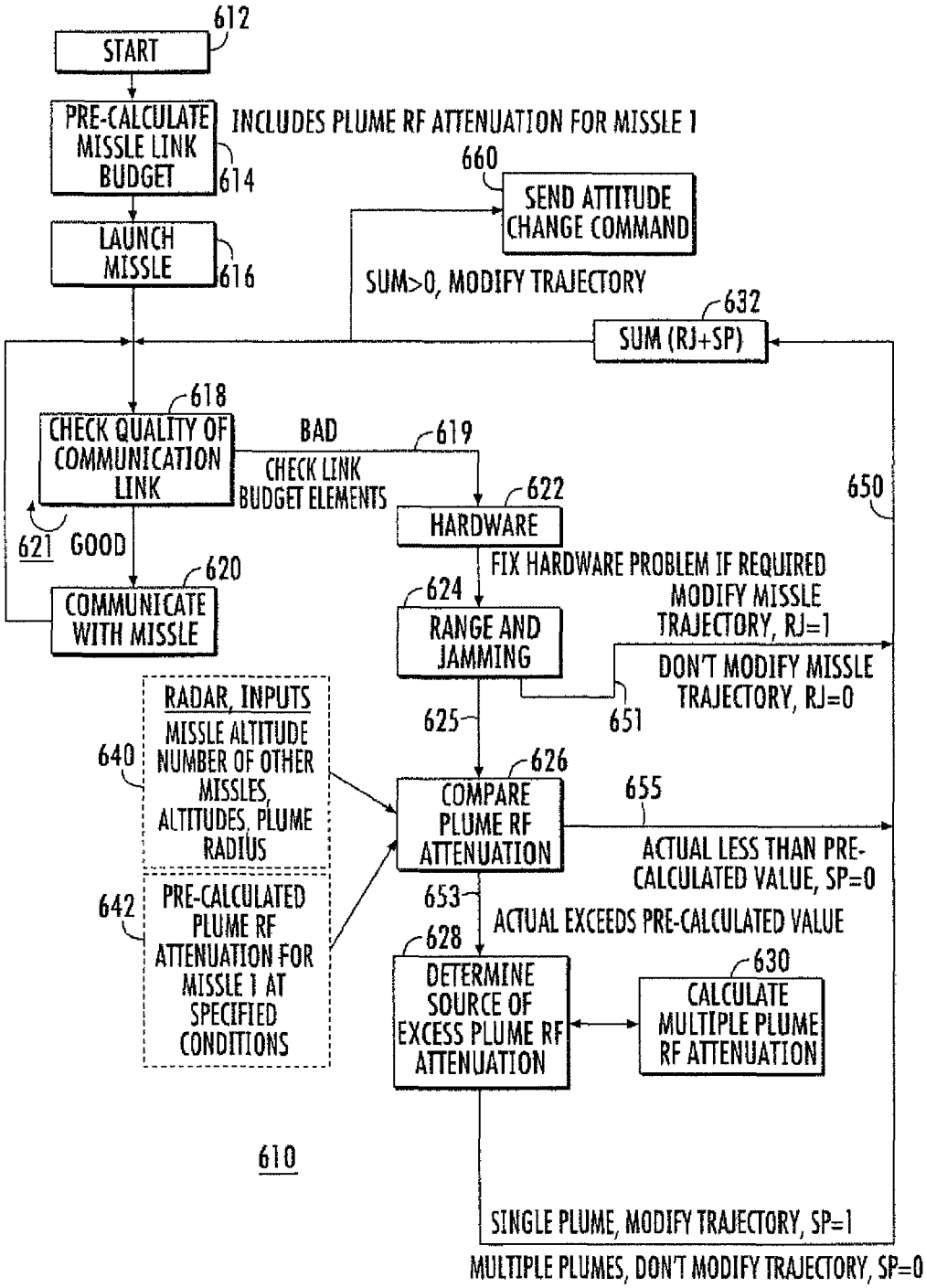
FIG. 6 is a simplified flow chart illustrating logic flow associated with the control system of FIG. 5.

FIG. 6 is a simplified logic flow chart or diagram illustrating the processing performed in microprocessor block 512 of FIG. 5. In FIG. 6, the logic begins at a START block 612, and flows to a block 614. Block 614 represents the precalculation, according to the prior art, of the link budget for a single missile, namely the missile $\mathbf{18}_1$ of FIG. 3 with which communications are desired. Block 614 also contains a table with plume attenuation values as a function of altitude and aspect angle for missile $\mathbf{18}_1$. Alternatively, block 614 may be viewed as accessing the previously calculated value. From block 614, the logic 600 flows to a block 616, representing the launching of the missile $\mathbf{18}_1$ and initiation of link communications. From block 616, the control or logic flows to a block 618. Block 618 is a decision block which represents monitoring of the link budget or the quality (Q) of the link. Block 618 determines link quality by noting the presence or absence of two-way communication over the link. If the link quality is good, the logic flows by the GOOD path from block 618 to a block 620, which represents communication with the missile for purposes other than modifying the trajectory. If the link quality is GOOD, the logic returns to block 618, to thereby define a recurrent loop designated generally as 621, which checks link quality. If the link quality is found to be BAD by block 618, the logic leaves decision block 618 and flows by way of a path 619 to a block 622. The taking of path 619 represents the need to check the various elements of the link budget to determine the cause of the bad link. Block 622 determines if the problem is with hardware failure, as for example if a transmitter has failed, and also represents repair of the hardware problem, as by the switching into use of redundant hardware elements.

From block 622 of FIG. 6, the logic flows to a block 624. Block 624 represents a determination that factors other than plume attenuation, namely range and or jamming, are affecting the communication link. Block 624 evaluates range and jamming in known fashion, and produces on a flag output path 651*a* Range/Jamming (RJ) flag. Changing the trajectory of the missile $\mathbf{18}_1$ is likely to solve the communication link attenuation if either range or jamming is the cause of the problem. Consequently, if neither range nor jamming are deemed to be contributing to the bad link, the Range/Jamming flag takes on a value of logic 0 (RJ=0). A value of logic 0 suggests that the trajectory of missile $\mathbf{18}_1$ need not be changed. If range and jamming block 624 finds that the link attenuation problem is attributable to either range or jamming, the flag RJ is set to logic 1 (RJ=1) to modify the trajectory, and RJ value moves along path 651 to return path 650. Control logic flows from block 624 by way of path 625 to a block 626.

Block 626 represents a comparison of actual plume RF attenuation with the modeled plume attenuation to determine the source of, or reason for, any excess plume attenuation not attributable to hardware causes or to range or jamming. The current plume attenuation of missile $\mathbf{18}_1$ is generated in block 626 from current information supplied from the radar system and stored in block 640. This information may include the altitude and attitude of missile $\mathbf{18}_1$, the number of other missiles, and their plume radii. Block 642 represents the precalculated single-plume RF attenuation for the current conditions, as generated in block 614. Block 626 represents the calculation of the actual attenuation by subtracting all other effects from the link budget. These other effects include missile attitude and the number of supernumerary or additional missiles, their plume radii, range and jamming. Block 626 compares the pre-calculated plume RF attenuation for missile 1 (18 of FIG. 5) under the existing attitude and altitude conditions with the actual measured attenuation, represented by the contents of block 640, and produces a actual less than or greater than plume flag SP. If the actual link attenuation is less than the calculated link attenuation, the excess attenuation is not likely to be attributable to the presence of multiple plumes, in which case flag SP on path 655 takes on a value SP=0. The logic 610 of FIG. 6 ends at block 626 if a determination is made that the actual attenuation is less than the calculated attenuation. Thus, the logic flows from block 626 to block 628 when there is excess attenuation, which may possibly be attributable to the presence of multiple plumes.

Block 628 of FIG. 6 represents determination of the source of the excess plume attenuation. In order to make a determination if the source of the excess link attenuation is attributable to multiple plumes, block 628 must know what the attenuation attributable to multiple plumes would be. This calculation is performed in a block 630 using equations (2) and (3). The calculated value of multiple plume attenuation is communicated from block 630 to block 628. If the calculated multiple plume RF attenuation is less than the actual attenuation, block 628 deems the attenuation to be caused by some factor other than multiple plume attenuation, and produces an SP=1 flag on return logic path 650, thus tending to initiate a missile maneuver. If the link RF attenuation is greater than the calculated multiple plume attenuation, block 628 deems the attenuation to be attributable to the presence of multiple plumes, and generates an SP=0 flag on path 650. The generation of an SP=0 flag by block 628 implicitly recognizes that the attenuation problem is attributable to multiple plumes, which is a transitory condition which will presumably correct itself.

The SP flag from block 628 (if any), the SP flag from block 626 (if any), and the RJ flag from block 614 are coupled onto return logic path 650 and applied to a block 632. Block 632 sums the values of the RJ and SP flags. If the sum of the RJ and SP flags is found to be greater than zero, this is taken as an indication that the link attenuation can be improved by changing the attitude or heading of the trajectory of missile $\mathbf{18}_1$. The sum signal is applied to a block 660 to initiate transmission of a "change attitude" command to missile 181 if the sum is greater than zero. Control logic continues along return path 650 back to block 618 to define a recurrent loop where the process starts again to check the quality of the link.

Thus, A method for commanding an attitude change of a boosting missile ($\mathbf{18}_1$) to tend to maintain good communication link quality includes the step (614) of precalculating attenuation of a link (12) between the boosting missile and a ground station in the presence and in the absence of multiple missile plumes ($\mathbf{18}_2$, $\mathbf{18}_3$). If the actual link attenuation is less than the precalculated attenuation in the absence of multiple missile plumes (626), no attitude change is commanded (SP+RJ=0). If the actual link attenuation exceeds the precalculated value (path 653), the actual link attenuation is compared (628) with the calculated attenuation in the presence of multiple missile plumes (630). If the calculated multiple plume RF attenuation is less than the actual link attenuation, the attenuation is deemed to be caused by some factor other than multiple plume attenuation, and produces a flag (SP=1) for commanding a change in attitude of the boosting missile.

A method according to an aspect of the disclosure is for adjusting the track or path (22) of a boosting missile ($\mathbf{18}_1$) in order to maintain the quality or attenuation of a communication link (12) between the missile ($\mathbf{18}_1$) and a communication device (14) in the presence of at least one other boosting missile ($\mathbf{18}_2$). The method comprises the step of precalculating (614) a communication link budget including an attenuation factor (A), where the communication link budget attenuation factor (A) includes a table (614) of the attenuation characteristics of a communication path (12) extending to a single missile ($\mathbf{18}_1$) which, when operating, generates a plasma plume ($\mathbf{16}_1$). A first missile ($\mathbf{18}_1$) is provided, with the first missile ($\mathbf{18}_1$) including a motor or engine which, when operating, generates a plasma plume ($\mathbf{16}_1$), and which also includes an antenna (20) for transducing signals with a communication device (14). The first missile ($\mathbf{18}_1$) is initialized and launched. The number of additional boosting missiles ($\mathbf{18}_2$, $\mathbf{18}_3$, $\mathbf{18}_4$) traveling along paths lying in or immediately adjacent to the line of sight between the communication device (14) and the first missile ($\mathbf{18}_1$) is determined (640). The quality or attenuation factor of the link budget in the presence of the additional boosting missiles ($\mathbf{18}_2$, $\mathbf{18}_3$, $\mathbf{18}_4$) is determined (626). If (a) the link budget quality falls below a predetermined standard and (b) the loss is deemed to be attributable to the plumes ($\mathbf{16}_2$, $\mathbf{16}_3$, $\mathbf{16}_4$) of the additional boosting missiles ($\mathbf{18}_2$, $\mathbf{18}_3$, $\mathbf{18}_4$), the track of a missile is adjusted (632, 660, 514) to improve the quality.

A method according to another aspect of the disclosure is for adjusting the track or path of a boosting missile ($\mathbf{18}_1$) to maintain the quality of a communication link (12) between the missile ($\mathbf{18}_1$) and a communication device (14) in the presence of at least one other boosting missile ($\mathbf{18}_3$). The method comprises the steps of precalculating (614) a communication link budget including an attenuation factor (A), where the communication link budget attenuation factor (A) includes a table (614) of the attenuation characteristics of a communication path (12) extending to a single missile (18$_1$) which, when operating, generates a plasma plume (16$_1$). A first missile (18$_1$) is provided, the first missile (18$_1$) including a motor or engine which, when operating, generates a plasma plume (16$_1$), and which also includes an antenna (20) for transducing signals with a communication device (14). The first missile (18$_1$) is initialized (614) and launched (616). The characteristics of the environment of the first missile (18$_1$) are determined, including the number of additional boosting missile or missiles traveling along paths lying adjacent to the line of sight extending between the communication device and the first missile (18$_1$), and also including information relating to the exit plane areas of the boosting missiles. The quality of the link budget is determined (630) in the presence of the additional boosting missile or missiles as a function of the exit plane areas of the missiles.

A method according to yet another aspect of the disclosure is for determining if the attitude of a boosting missile (18$_1$) should be modified in order to improve the quality of a communication link (12) extending between the boosting missile (18$_1$) and a stationary communication device (14). The method comprises the step of precalculating (614) a missile (18$_1$) link budget including attenuation attributable to the engine plume (16$_1$)) of the boosting missile (18$_1$) with which communication is desired. The missile (18$_1$) with which communication is desired is launched (616). The quality of the link is determined (618) as good or bad. If the quality of the link is bad, the actual link attenuation to the boosting missile is determined (619) under the existing conditions, and the actual link attenuation is compared (626) to the precalculated value to determine if the actual link attenuation is greater than or less than the precalculated value. If the actual link attenuation is less than the precalculated value, a signal (SP=0) is generated (626) indicating that the boosting missile attitude need not be changed. The link attenuation in the presence of multiple missile plumes is calculated (630). If the actual link attenuation is greater than the precalculated value, the actual link attenuation is compared (628) with the calculated link attenuation in the presence of multiple missile plumes, and if the calculated link attenuation in the presence of multiple missile plumes is less than the actual link attenuation, a signal is generated indicating that the boosting missile attitude need not be changed. If the calculated link attenuation in the presence of multiple missile plumes is greater than the actual link attenuation, a signal is generated indicating that the boosting missile attitude needs to be changed.

What is claimed is:

1. A method for adjusting the track or path of a boosting missile to maintain the quality of a communication link between said missile and a communication device in the presence of at least one other boosting missile, said method comprising the steps of:

precalculating a communication link budget including an attenuation factor, said attenuation factor including a table of attenuation characteristics of a communication path extending to a single missile which, when operating, generates a plasma plume;

providing a first missile, said first missile including a motor which, when operating, generates a plasma plume, and which also includes an antenna for transducing signals with a communication device;

initializing and launching said first missile;

determining a number of additional boosting missile or missiles traveling along paths lying in or immediately adjacent to a line of sight between said communication device and said first missile;

determining a quality of said communication link in the presence of said additional boosting missile or missiles; and if (a) said communication link quality falls below a predetermined standard and (b) the link quality is deemed to be attributable to the plumes of said first and additional missile or missiles, adjusting a missile track to improve said link quality.

2. A method according to claim 1, wherein said step of adjusting a missile track includes the step of adjusting the track of said first missile.

3. A method according to claim 1, wherein said step of determining the quality of said link in the presence of said additional boosting missile or missiles includes the step of calculating $$A_{TOTAL} = \left[1 + 0.1\left(\frac{R_{eq}}{R_1}\right)\right]\left[1 + \frac{0.26(h_1 - h_{avg})}{A_1}\right]A_1$$

where:

$A_1$ is a predetermined value of plume attenuation for the first missile;

$h_1$ is an altitude associated with the first missile;

$A_{TOTAL}$ is a total attenuation for multiple plumes 1 through N, which plumes may be at different altitudes, and for $h \leqq 70$ km;

$h_{avg}$ is an average altitude of all plumes (km); and $R_{eq}$ is an equivalent nozzle plane exit radius based on the total nozzle exit plane area associated with all the missile plumes $$R_{eq}=(R_1^2+R_2^2+R_3^2+R_4^2+\ldots+R_N^2)^{1/2}.$$

4. A method for adjusting the track or path of a boosting missile to maintain the quality of a communication link between said missile and a communication device in the presence of at least one other boosting missile, said method comprising the steps of:

precalculating a communication link budget including a communication link attenuation factor, said communication link budget attenuation factor including a table of attenuation characteristics of a communication path extending to a missile which, when operating, generates a plasma plume;

providing a first missile, said first missile including a motor which, when operating, generates a plasma plume, and which also includes an antenna for transducing signals with a communication device;

initializing and launching said first missile;

determining characteristics of an environment of said first missile, including a number of additional boosting missile or missiles traveling along paths lying adjacent to a line of sight extending between said communication device and said first missile, and also including information relating to exit plane areas of the boosting missiles; and determining a quality of said communication link in the presence of said additional boosting missile or missiles as a function of the exit plane areas of the boosting missiles; and adjusting a track or path of said first missile if said quality of said communication link quality is less than said communication link budget.

5. The method of claim 4, wherein the step of determining a quality of said communication link includes determining if factors other than plume attenuation are affecting the quality of the communication link.

6. The method of claim 4, wherein the factors other than plume attenuation are selected from the list consisting of hardware failure, range and jamming.

7. The method of claim 4, wherein the step of determining characteristics of an environment of said first missile comprises determining an attenuation attributable to the passage of an RF signal of said communication link through plumes of said number of additional boosting missile or missiles.

8. The method of claim 7, wherein the step of determining an attenuation is based on at least an altitude of the first missile, an average altitude of all plumes, and an equivalent nozzle plane exit radius based on a total nozzle exit plane area associated with all plumes.

9. A method for determining if the attitude of a boosting missile should be modified in order to improve the quality of a communication link extending between the boosting missile and a stationary communication device, said method comprising the steps of:

precalculating a missile link budget including attenuation attributable to an engine plume of said boosting missile;

launching said boosting missile;

determining the quality of said link as being good or bad;

if said quality of said link is bad, determining an actual link attenuation for the boosting missile under existing conditions, and comparing the actual link attenuation to the precalculated missile link budget to determine if the actual link attenuation is greater than or less than the precalculated missile link budget;

if said actual link attenuation is less than the precalculated missile link budget, generating a signal indicating that the boosting missile attitude need not be changed;

calculating link attenuation in the presence of multiple missile plumes; and if said actual link attenuation is greater than said precalculated missile link budget, comparing said actual link attenuation with said calculated link attenuation in the presence of multiple missile plumes, and if said calculated link attenuation in the presence of multiple missile plumes is less than said actual link attenuation, generating a signal indicating that the boosting missile attitude need not be changed, and if said calculated link attenuation in the presence of multiple missile plumes is greater than said actual link attenuation, generating a signal indicating that the boosting missile attitude needs to be changed.

10. A method according to claim 9, wherein said step of calculating link attenuation in the presence of multiple missile plumes comprises the step of calculating $$A_{TOTAL} = \left[1 + 0.1\left(\frac{R_{eq}}{R_1}\right)\right]\left[1 + \frac{0.26(h_1 - h_{avg})}{A_1}\right]A_1$$

where:

$A_1$ is a predetermined value of plume attenuation for the boosting missile;

$h_1$ is an altitude associated with the boosting missile;

$A_{TOTAL}$ is a total attenuation for multiple plumes 1 through N, for $h \leqq 70$ km;

$h_{avg}$ is an average altitude of all plumes (km); and $R_{eq}$ is an equivalent nozzle plane exit radius based on the total nozzle exit plane area associated with all the missile plumes according to the formula:

$$R_{eq}=(R_1^2+R_2^2+R_3^2+R_4^2+\ldots+R_N^2)^{1/2}.$$

11. The method of claim 9, wherein the step of determining the quality of said link as being good or bad link includes determining if factors other than plume attenuation are affecting the quality of the communication link.

12. The method of claim 9, wherein the factors other than plume attenuation are selected from the list consisting of hardware failure, range and jamming.

13. The method of claim 9, wherein the step of calculating link attenuation in the presence of multiple missile plumes comprises the step of determining an attenuation attributable to the passage of an RF signal of said communication link through said multiple missile plumes.

14. The method of claim 13, wherein the step of determining an attenuation is based on at least an altitude of the boosting missile, an average altitude of all plumes, and an equivalent nozzle plane exit radius based on a total nozzle exit plane area associated with all plumes.

15. A system for determining if the attitude of a missile should be modified to improve the quality of a communication link extending between the missile and a communication device, the system comprising:

a processor executing instructions for performing the method comprising:

calculating a communication link budget including an attenuation factor, said attenuation factor including attenuation characteristics of a communication path extending between a communication device and a first missile, the first missile having a plasma plume;

determining a number of additional missiles traveling along paths lying in or immediately adjacent to a line of sight between said communication device and said first missile;

determining a quality of said communication link in the presence of said number of additional missiles; and if said link quality falls below a predetermined standard and the link quality is deemed to be attributable to the plumes of said first missile and said number of additional missiles, adjusting a missile track to improve said link quality.

16. The system according to claim 15, wherein said step of adjusting a missile track includes the step of adjusting the track of said first missile.

17. The system according to claim 15, wherein said step of adjusting a missile track includes the step of adjusting the track of at least one of said number of additional missiles.

18. The system according to claim 15, wherein said step of determining a quality of said communication link in the presence of said number of additional missiles includes the step of calculating $$A_{TOTAL} = \left[1 + 0.1\left(\frac{R_{eq}}{R_1}\right)\right]\left[1 + \frac{0.26(h_1 - h_{avg})}{A_1}\right]A_1$$

where:

$A_1$ is a predetermined value of plume attenuation for the first missile;

$h_1$ is an altitude associated with the first missile;

$A_{TOTAL}$ is a total attenuation for multiple plumes 1 through N, which plumes may be at different altitudes, and for $h \leqq 70$ km;

$h_{avg}$ is an average altitude of all plumes (km); and $R_{eq}$ is an equivalent nozzle plane exit radius based on the total nozzle exit plane area associated with all the missile plumes $$R_{eq}=(R_1^2+R_2^2+R_3^2+R_4^2+\ldots+R_N^2)^{1/2}.$$

19. The system according to claim 15, wherein the step of determining a quality of said communication link in the presence of said number of additional missiles is based on at least an altitude of the first missile, an average altitude of all plumes, and an equivalent nozzle plane exit radius based on a total nozzle exit plane area associated with all plumes.

20. The system according to claim 15, wherein the step of determining a quality of said communication link comprises the additional step of determining if factors other than plume attenuation are affecting the quality of the communication link, wherein said factors are selected from the list consisting of hardware failure, range and jamming.

* * * * *